US008322792B2

(12) United States Patent
Chen

(10) Patent No.: US 8,322,792 B2
(45) Date of Patent: Dec. 4, 2012

(54) FURNITURE SET

(76) Inventor: Lionel T. Chen, Rowland Heights, CA (US)

( * ) Notice: Subject to any disclaimer, the term of this patent is extended or adjusted under 35 U.S.C. 154(b) by 337 days.

(21) Appl. No.: 12/589,871

(22) Filed: Oct. 29, 2009

(65) Prior Publication Data

US 2011/0101747 A1 May 5, 2011

(51) Int. Cl.
*A47C 17/02* (2006.01)

(52) U.S. Cl. ..... 297/440.1; 297/232; 297/440.15

(58) Field of Classification Search ..... 297/440.1, 297/440.14, 440.15, 440.23, 232
See application file for complete search history.

(56) References Cited

U.S. PATENT DOCUMENTS

| | | | | |
|---|---|---|---|---|
| 2,597,860 | A * | 5/1952 | Gerber et al. | 297/411.28 |
| 2,660,228 | A * | 11/1953 | Reinhold | 297/440.1 |
| 3,104,913 | A * | 9/1963 | Faulkner et al. | 297/218.3 |
| 3,658,382 | A * | 4/1972 | Anderson | 297/451.8 |
| 4,043,591 | A * | 8/1977 | Lehmann | 297/248 |
| 5,601,340 | A * | 2/1997 | Stout | 297/440.16 |
| 5,678,897 | A * | 10/1997 | Prestia | 297/440.15 |
| 5,890,767 | A * | 4/1999 | Chang | 297/440.14 |
| 6,796,614 | B1 * | 9/2004 | Paul | 297/440.14 |
| 7,020,911 | B2 * | 4/2006 | Oldham | 5/12.2 |
| 7,252,339 | B2 * | 8/2007 | Owens | 297/440.1 |
| 7,387,344 | B2 * | 6/2008 | Yu | 297/440.1 |
| 7,547,073 | B2 * | 6/2009 | White et al. | 297/440.1 |
| 2002/0093235 | A1 * | 7/2002 | Niederman et al. | 297/440.1 |

* cited by examiner

*Primary Examiner* — Peter R. Brown
(74) *Attorney, Agent, or Firm* — Law Office of Roger C. Hsu; Charles R. Sutton

(57) ABSTRACT

This invention concerns a sofa which solves the problems of the prior art by providing a sofa that can easily be assembled or disassembled by the end consumer at home. The furniture set described can be assembled so the major piece is either to the left of the secondary piece or to the right of the secondary piece. The way this invention accomplishes these results is as follows: Chaise sections can be assembled by placing the seat back flat on the ground and placing the seat frame/arm upright on top of the seat back. A metal threaded rod is used to connect the seat frame and the seat back. A metal nut is used to secure the seat frame to the back using a wrench that comes provided in the package of the kit. The legs are then twisted onto the bottom of the seat frame.

3 Claims, 10 Drawing Sheets

FURNITURE SET

STATEMENT REGARDING FEDERALLY SPONSORED RESEARCH AND DEVELOPMENT

This invention was not made using federally sponsored research and development.

CROSS REFERENCE TO RELATED APPLICATIONS

There are no related applications.

THE NAMES OF THE PARTIES TO A JOINT RESEARCH AGREEMENT

None.

REFERENCE TO A SEQUENCE LISTING

There is no sequence listing in this application.

BACKGROUND OF THE INVENTION

This invention relates to the field of furniture and more particularly to consumer sofa and love seat kits. Sofas have long been known in the furniture making arts but the traditional sofa design with a one piece frame is not susceptible to easy assembly and disassembly. It is also not easy to package such a sofa in a flat box for storage at the seller's warehouse. Frequently the end consumer will have limitations in the layout of the home that create a need for a sectional sofa having a love seat on the left rather than the right, or vice versa.

BRIEF SUMMARY OF THE INVENTION

This invention concerns a sofa which solves the problems of the prior art by providing a sofa that can easily be assembled or disassembled by the end consumer at home. It can be assembled in two different mirror image configurations depending on the needs of the individual consumer as dictated by the layout of the home or the positions of other furniture. The disassembled sofa can be stored in one or more flat boxes. Storage in the flat box not only helps the warehouse to store the sofa, but when the end user has purchased the sofa it is easier in such a flat box to transport it to the location where it will be assembled. The way this invention accomplishes these results is as follows: Chaise sections can be assembled by placing the seat back flat on the ground and placing the seat frame/arm upright on top of the seat back. A metal threaded rod is used to connect the seat frame and the seat back. A metal nut is used to secure the seat frame to the back using a wrench that comes provided in the package of the kit. The legs are then twisted onto the bottom of the seat frame.

DETAILED DESCRIPTION OF THE INVENTION

This invention concerns a sofa which solves the problems of the prior art by providing a sofa that can easily be assembled or disassembled by the end consumer at home into either a left handed, or a right handed configuration. The disassembled sofa can be stored in a flat box. Storage in the flat box not only helps the warehouse to store the sofa, but when the end user has purchased the sofa it is easier in such a flat box to transport it to the location where it will be assembled. The way this invention accomplishes these results is as follows: Chaise sections can be assembled by placing the seat back flat on the ground and placing the seat frame/arm upright on top of the seat back. A metal threaded rod is used to connect the seat frame and the seat back. A metal nut is used to secure the seat frame to the back using a wrench that comes provided in the package of the kit. The legs are then twisted onto the bottom of the seat frame.

Figure 1:
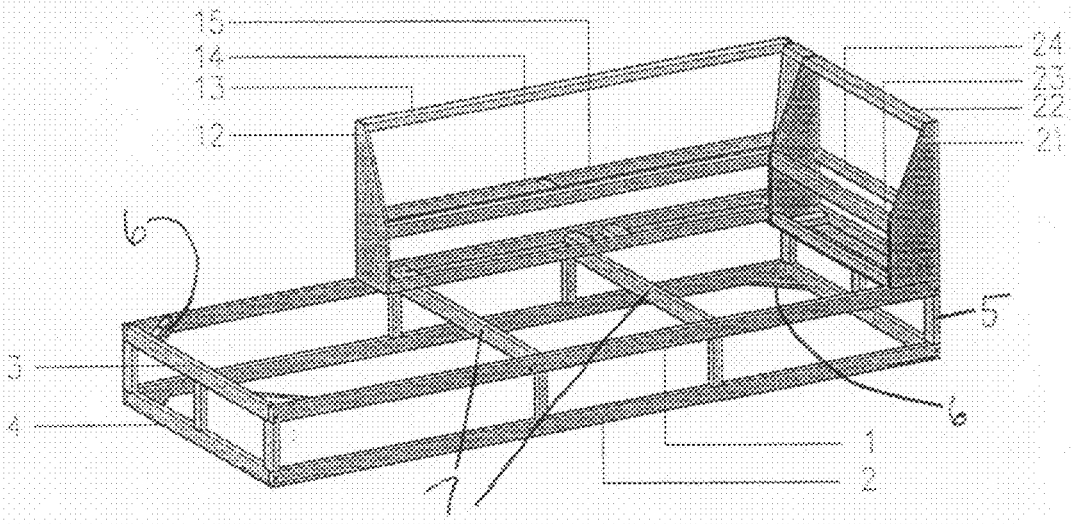
FIG. 1 a perspective cutaway view of the First portion chassis of the invention FIG. 2 a perspective cutaway view of the second portion chassis of the invention FIG. 3 plan view of first and second portion chassis in right handed assembly FIG. 4 plan view of first and second portion chassis in left handed assembly FIG. 5 exploded view of one example each of the parts of the invention FIG. 6 partially exploded view of left handed assembly FIG. 7 partially exploded view of first portion; left handed assembly build FIG. 8 partially exploded view of first portion; left hand assembly build showing assembly directions FIG. 9 perspective view assembled first portion chassis; left hand assembly build FIG. 10 perspective view assembled first portion left hand assembly build FIG. 11 partially exploded view of second portion; left hand assembly build FIG. 12 partially exploded view of second portion; left hand assembly build showing assembly directions FIG. 13 perspective view assembled second portion chassis; left hand assembly build FIG. 14 perspective view assembled second portion; left hand assembly build FIG. 15 perspective view of orientation of first and second portion chassis in left hand assembly build (with ottoman)

Turning now to FIG. 1, a perspective cutaway view of the First portion chassis of the invention, a wooden frame can be seen to exist inside the first portion. Typically, this is covered by upholstery and perhaps padding, which is not seen here. The frame can constitute a three dimensional oblong box composed of a pair of rectangles separated by spacers so the two rectangles represent parallel planes. Being rectangles, they would have four sides, though optimally for this type of furniture the four sides are not of the same length. Typically each rectangle would have long sides (1), (2) and there would be two long sides per rectangle. Those long sides would be opposite one another on each rectangle and of equal length. Each rectangle would also have two shorter sides such as those seen at (3) and (4). Those shorter sides would be opposite one another on each rectangle and of equal length to one another with the result that the angles of the rectangle are each 90 degrees. The relationship of the two rectangles can not only that they are parallel, but that as well they have the same surface area. This latter relationship would be typical in the case where the longer side (1) is equal in length to the longer side (2) and the shorter side (3) is equal in length to the shorter side (4). The spacers (5) separate the two rectangles and hold them in position. Corner braces (6) can be used to increase the strength of the rectangles against torsion or shear forces. Cross braces (7) may also be used to strengthen the apparatus.

Figure 2:
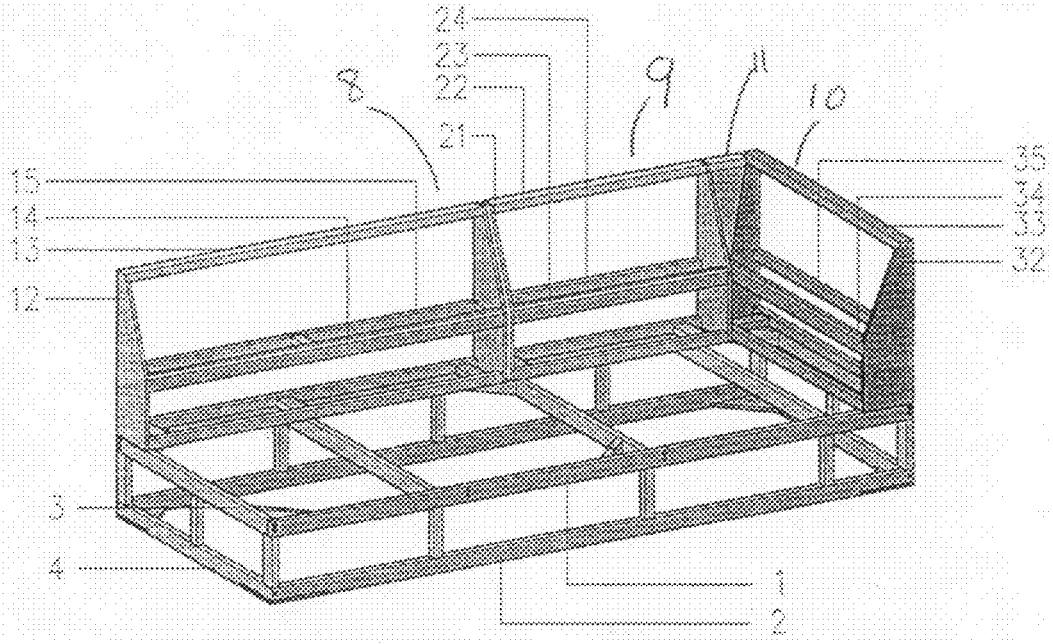

Turning now to FIG. 2, a perspective cutaway view of the second portion chassis of the invention, the portions can be seen not only to have a box formed of two parallel spaced rectangles, but also to have vertical supports, such as those seen at (8), (9), (10), and (11). These supports will typically have a polygonal side member such as those seen at (12), (21), and (32) separated from an identical polygonal side member by cross beams such as those seen at (13), (14), (15), (22), (23), (24), (33), (34), and (35). The polygons that form the side members are shaped in such a way that they will facilitate easy resting back of the person when they are upholstered and assembled. A specialized form of a vertical support may be present such as that seen at (11). It is sized and shaped in such a manner as to occupy a space between the other vertical supports that may have been formed at their joints by the fact of the sloping backrest configuration.

Figure 3:
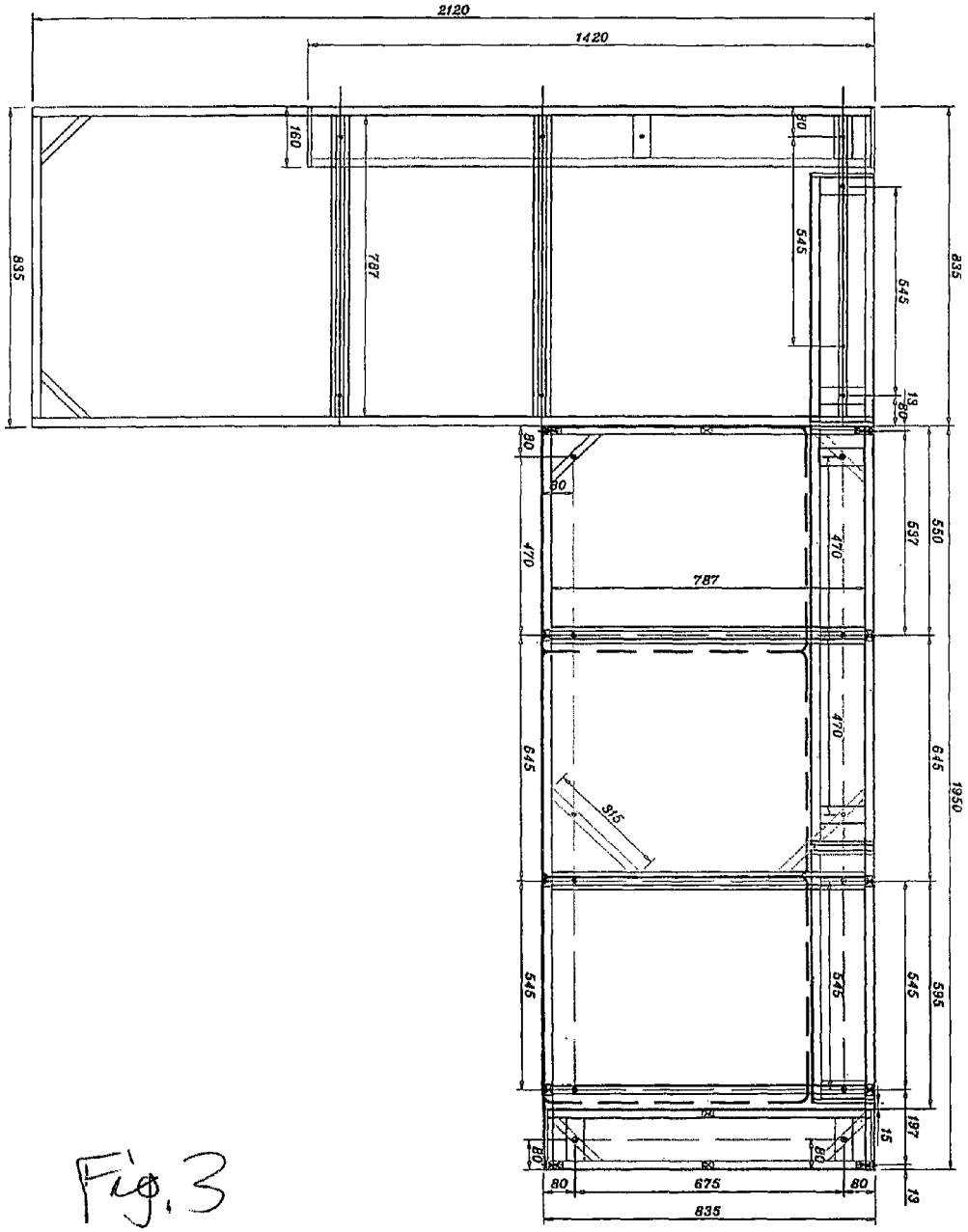

Turning now to FIG. 3, a plan view of first and second portion chassis in right handed assembly, one embodiment is seen from overhead and proportional measurements are given for the lengths of various respective spaces.

Figure 4:
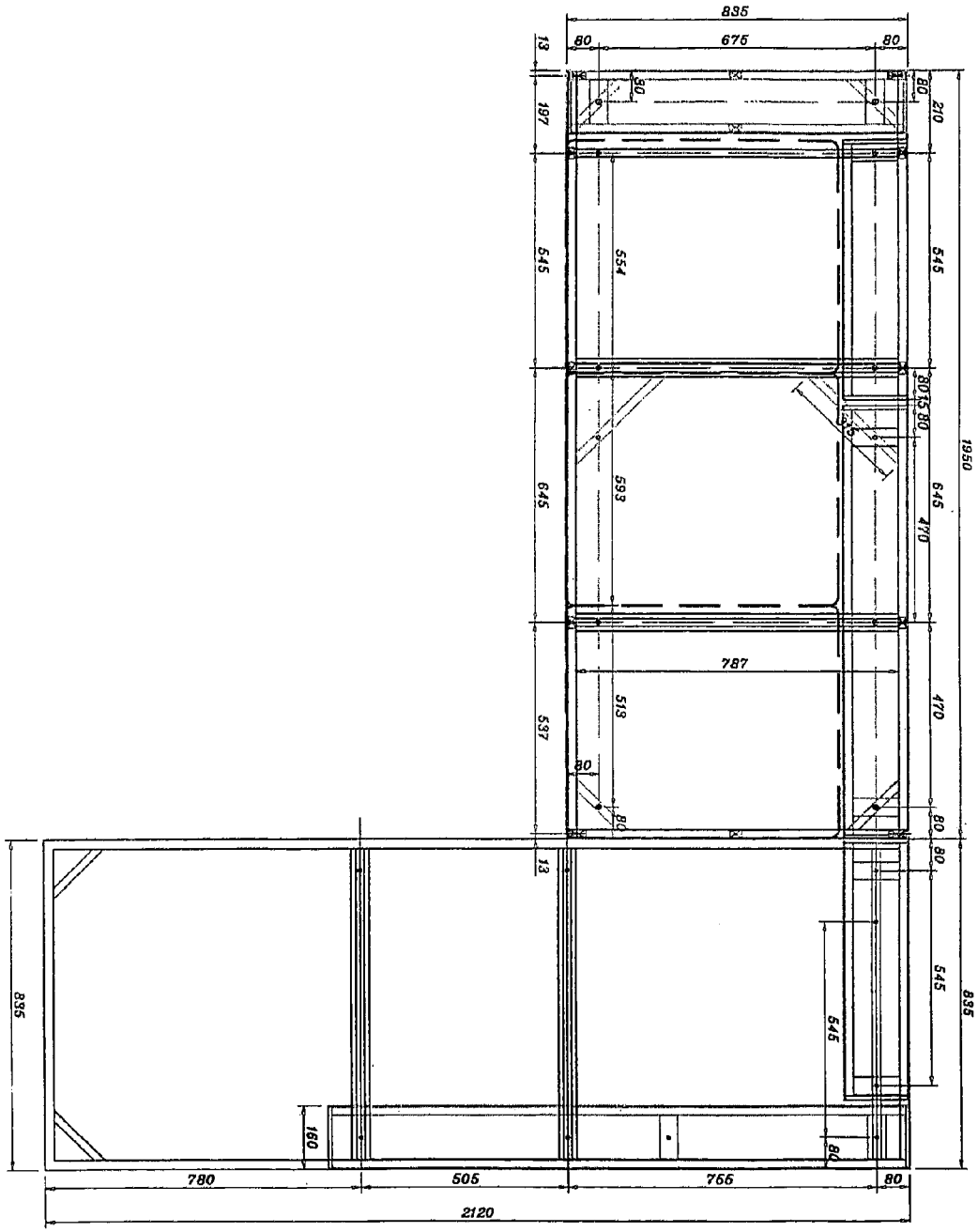

Turning now to FIG. 4, a plan view of first and second portion chassis in left handed assembly, one embodiment is seen from overhead and proportional measurements are given for the lengths of various respective spaces.

Figure 5:
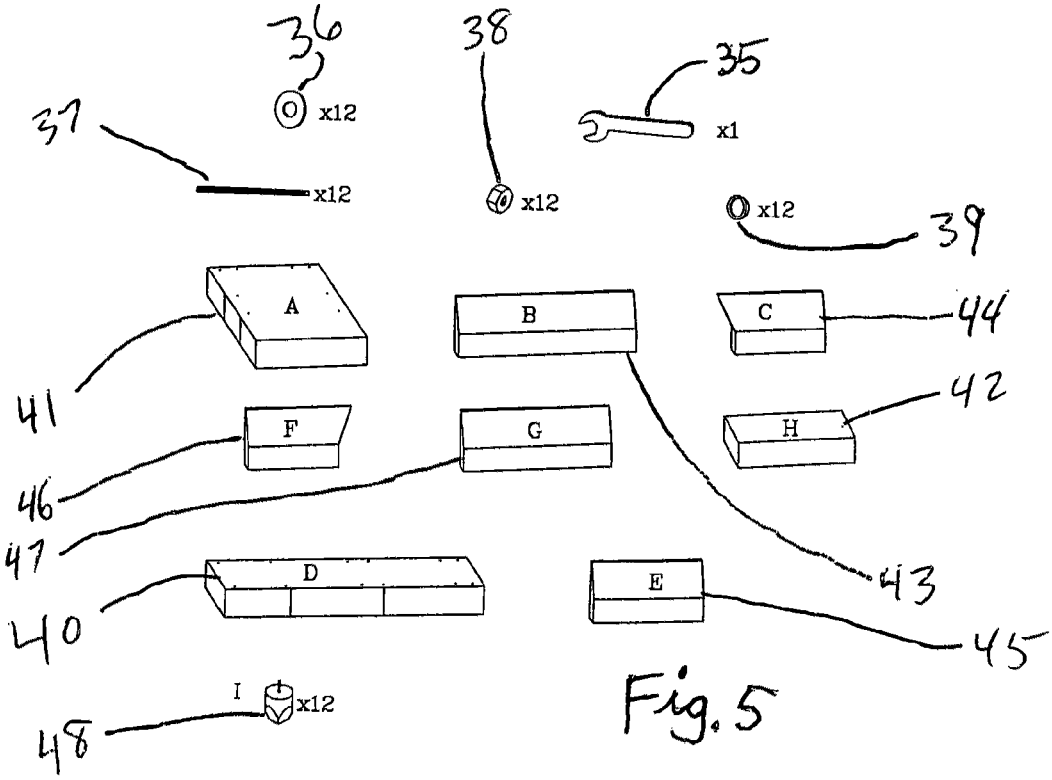

Turning now to FIG. 5, an exploded view of one example each of the parts of the invention, the preferred embodiment of the invention can be seen to come equipped with one wrench (35), 12 washers (36), 12 metal threaded rods (37), 12 nuts (38), 12 lock washers (39), a primary base (40), a secondary base (41), an ottoman base (42), a first back (43), a second back (44), a third back (45), a fourth back (46), a fifth back (47), and 12 feet (48).

Figure 6:
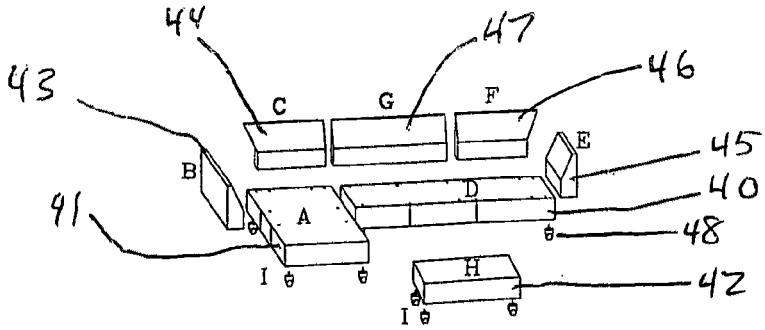

Turning now to FIG. 6, a partially exploded view of left handed assembly, the primary base (40), secondary base (41), ottoman base (42), first back (43), second back (44), third back (45), fourth back (46), fifth back (47), and feet (48) are shown in exploded but near assemble positioning so the manner of furniture assembly of the preferred embodiment can be seen.

Figure 7:
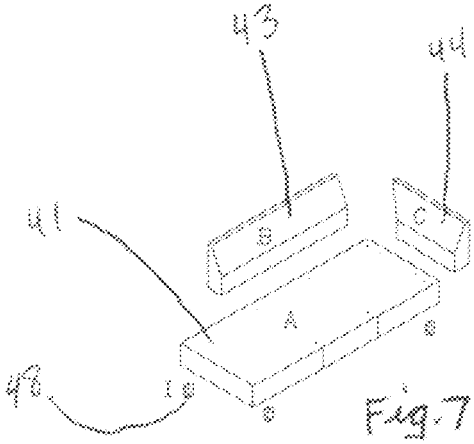

Turning now to FIG. 7, a partially exploded view of first portion; left handed assembly build can be seen.

Figure 8:
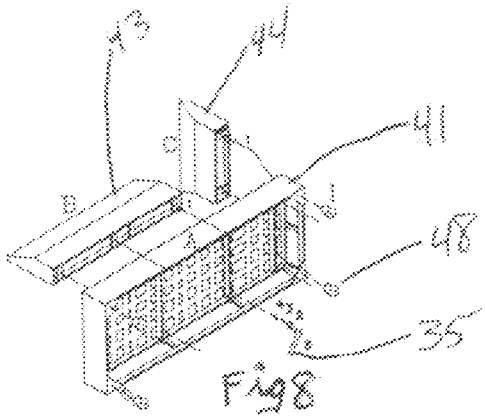

Turning now to FIG. 8, a partially exploded view of first portion; left hand assembly build showing assembly directions can be seen.

Figure 9:
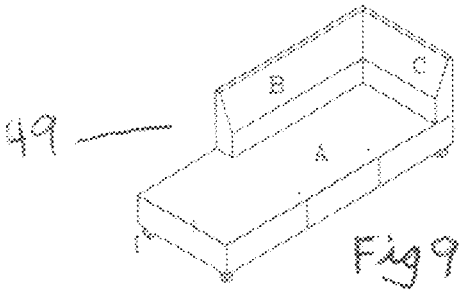

Turning now to FIG. 9, a perspective view assembled first portion chassis (49); left hand assembly build can be seen.

Figure 10:
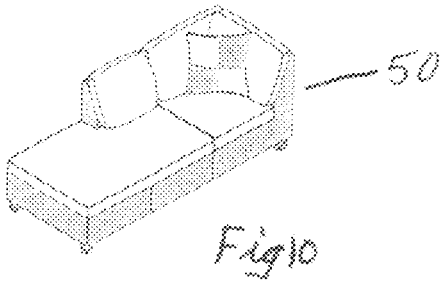

Turning now to FIG. 10, a perspective view assembled first portion (50) left hand assembly build can be seen.

Figure 11:
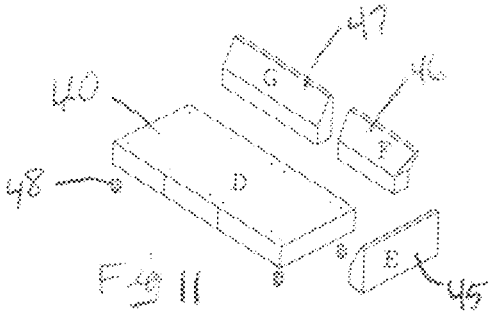

Turning now to FIG. 11, a partially exploded view of second portion; left hand assembly build can be seen.

Figure 12:
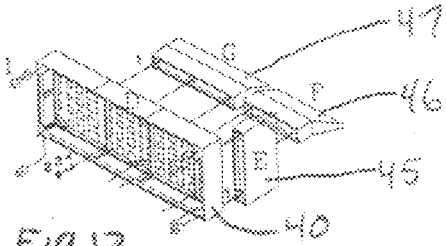

Turning now to FIG. 12, a partially exploded view of second portion; left hand assembly build showing assembly directions can be seen.

Figure 13:
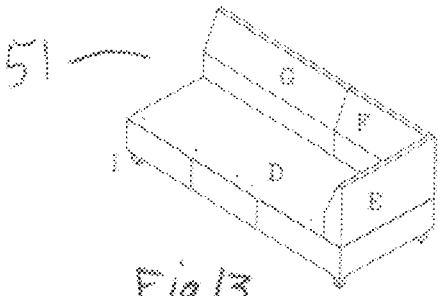

Turning now to FIG. 13, a perspective view assembled second portion chassis (51); left hand assembly build can be seen.

Figure 14:
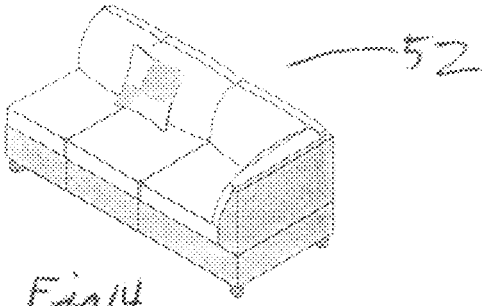

Turning now to FIG. 14, a perspective view assembled second portion (52); left hand assembly build can be seen.

Figure 15:
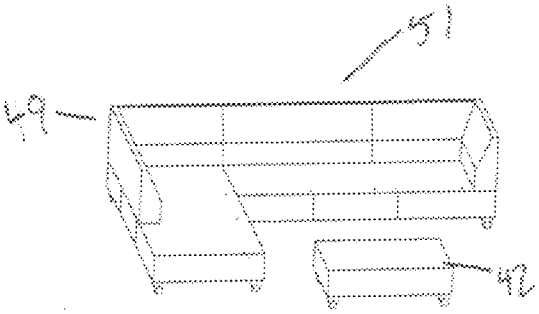

Turning now to FIG. 15, a perspective view of orientation of first and second portion chassis (49) (51) in left hand assembly build (with ottoman (42)) can be seen.

Figure 16:
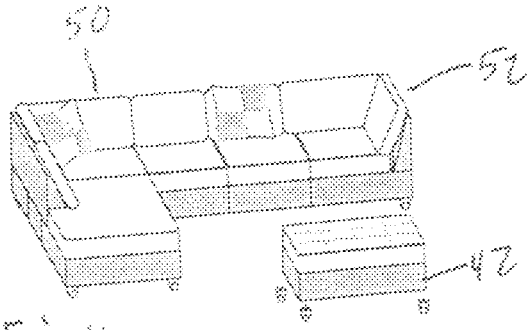
FIG. 16 perspective view of completed left hand assembly build (with ottoman)

Turning now to FIG. 16, a perspective view of completed left hand assembly build (with ottoman) can be seen.

Figure 17:
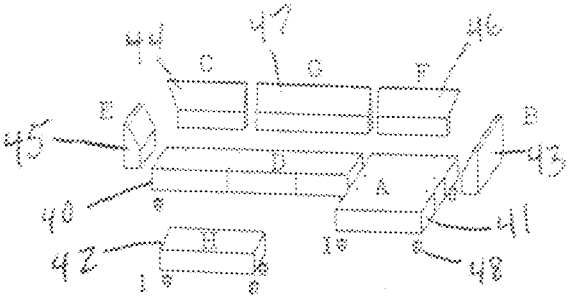
FIG. 17 partially exploded view of right handed assembly

Turning now to FIG. 17, a partially exploded view of right handed assembly, the primary base (40), secondary base (41), ottoman base (42), first back (43), second back (44), third back (45), fourth back (46), fifth back (47), and feet (48) are shown in exploded but near assemble positioning so the manner of furniture assembly of the preferred embodiment can be seen.

Figure 18:
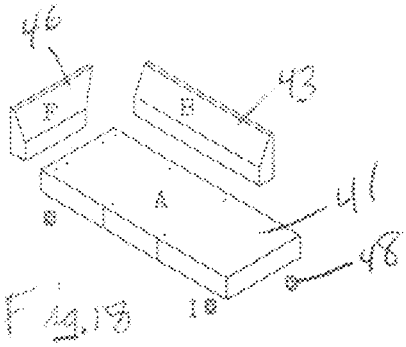
FIG. 18 partially exploded view of first portion; right handed assembly build FIG. 19 partially exploded view of first portion; right hand assembly build showing assembly directions FIG. 20 perspective view assembled first portion chassis; right hand assembly build FIG. 21 perspective view assembled first portion right hand assembly build FIG. 22 partially exploded view of second portion; right hand assembly build FIG. 23 partially exploded view of second portion; right hand assembly build showing assembly directions FIG. 24 perspective view assembled second portion chassis; right hand assembly build FIG. 25 perspective view assembled second portion; right hand assembly build FIG. 26 perspective view of orientation of first and second portion chassis in right hand assembly build (with ottoman)

Turning now to FIG. 18, a partially exploded view of first portion; right handed assembly build can be seen.

Figure 19:
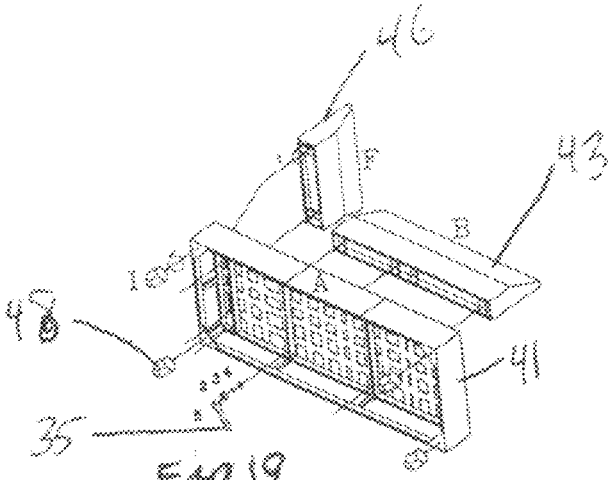

Turning now to FIG. 19, a partially exploded view of first portion; right hand assembly build showing assembly directions can be seen.

Figure 20:
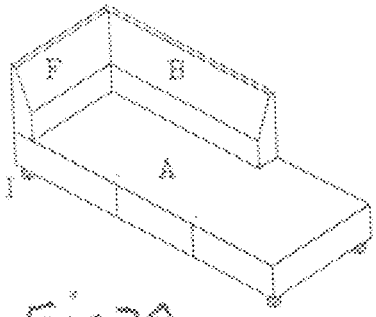

Turning now to FIG. 20, a perspective view assembled first portion chassis; right hand assembly build can be seen.

Figure 21:
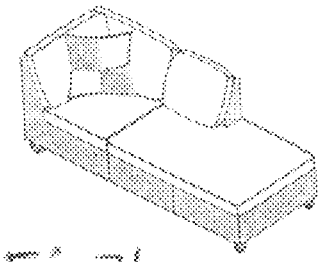

Turning now to FIG. 21, a perspective view assembled first portion right hand assembly build can be seen.

Figure 22:
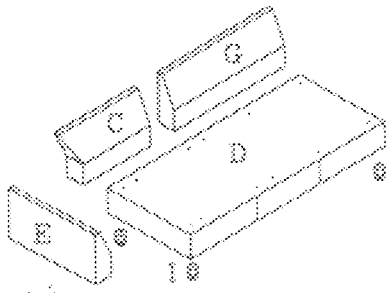

Turning now to FIG. 22, a partially exploded view of second portion; right hand assembly build can be seen.

Figure 23:
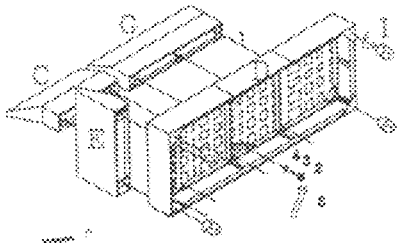

Turning now to FIG. 23, a partially exploded view of second portion; right hand assembly build showing assembly directions can be seen.

Figure 24:
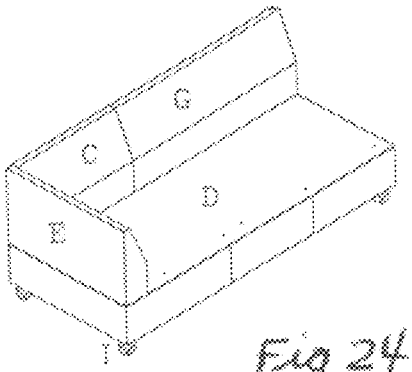

Turning now to FIG. 24, a perspective view assembled second portion chassis; right hand assembly build can be seen.

Figure 25:
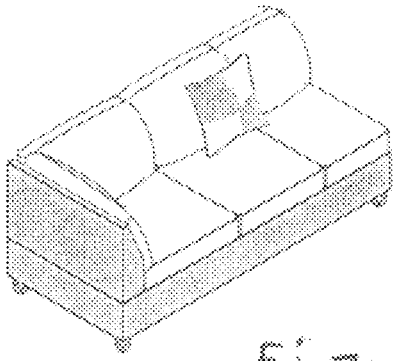

Turning now to FIG. 25, a perspective view assembled second portion; right hand assembly build can be seen.

Figure 26:
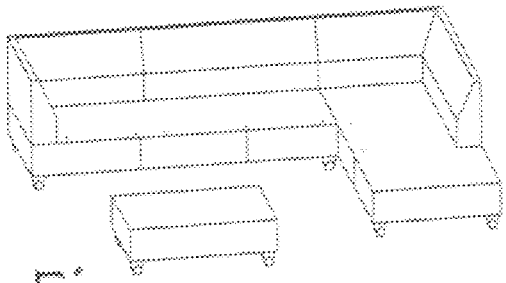

Turning now to FIG. 26, a perspective view of orientation of first and second portion chassis in right hand assembly build (with ottoman) can be seen.

Figure 27:
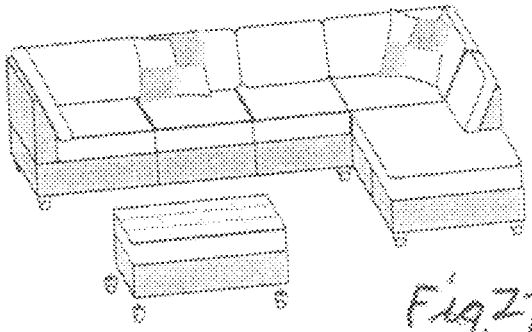
FIG. 27 perspective view of completed right hand assembly build (with ottoman)

Turning now to FIG. 27, a perspective view of completed right hand assembly build (with ottoman) can be seen.

Figure 28:
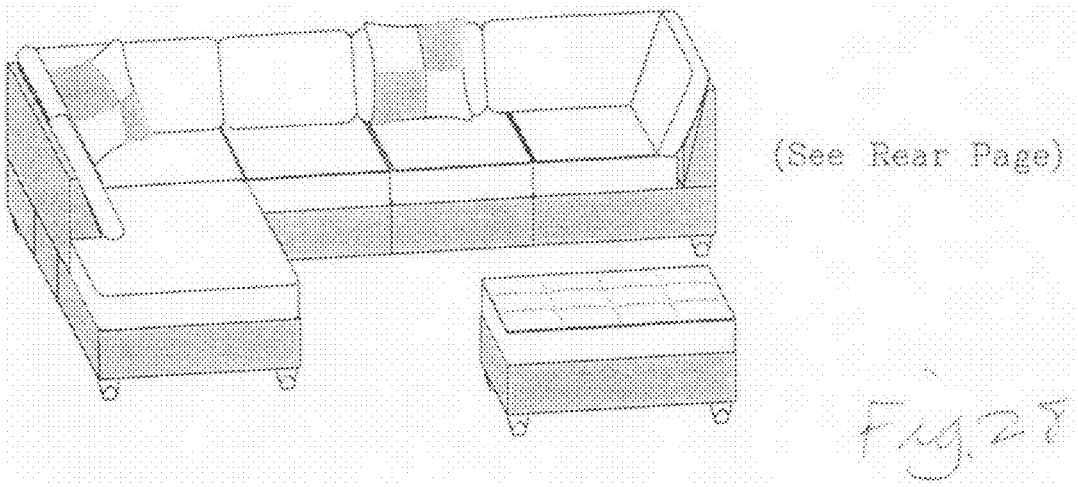
FIG. 28 Perspective view of left hand assembly build (with ottoman)

Turning now to FIG. 28, a Perspective view of left hand assembly build (with ottoman) can be seen.

Figure 29:
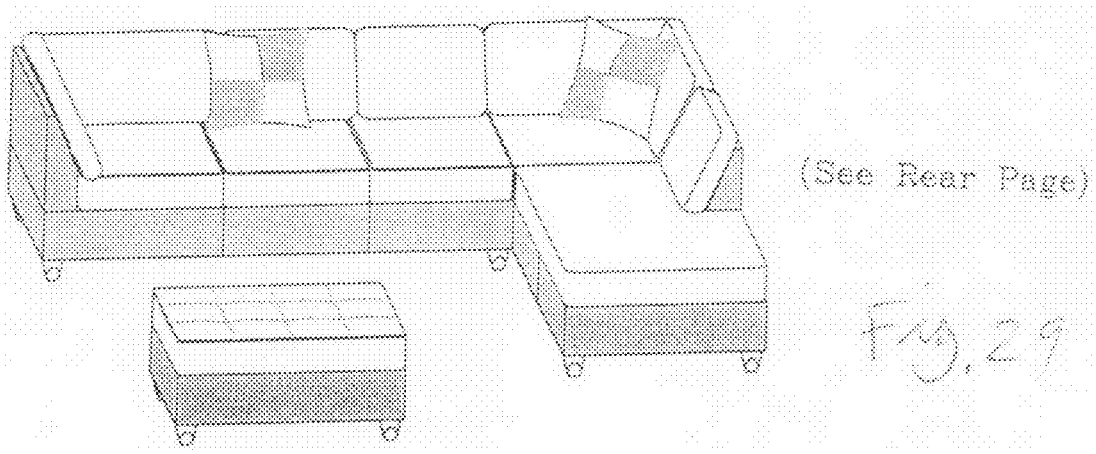
FIG. 29 perspective view of right hand assembly build (with ottoman)

Turning now to FIG. 29, a perspective view of right hand assembly build (with ottoman) can be seen.

I claim:

1. A furniture set comprising:

attachment means, a chaise lounge base, a chaise lounge back, a chaise lounge side, a sofa base, a sofa back, a sofa side, feet, and an ottoman base;

said ottoman base adapted to receive said attachment means and said feet at a plurality of foot receptacles;

said sofa base adapted to receive said attachment means and said feet at a plurality of basal receptacles;

said chaise lounge base adapted to receive said attachment means and said feet at a plurality of perimeter receptacles;

said chaise lounge base having a first upper surface, said chaise lounge back connects to said first upper surface using said attachment means, said chaise lounge side connects to said first upper surface using said attachment means, and said feet connect to said chaise lounge base distally to said first upper surface using said attachment means;

said sofa base having a second upper surface, said sofa back connects to said second upper surface using said attachment means, said sofa side connects to said second upper surface using said attachment means, and said feet connect to said sofa base distally to said second upper surface using said attachment means;

said chaise lounge back having a first long axis and a first cross section perpendicular to said first long axis;

said chaise lounge side having a second long axis and a second cross section perpendicular to said second long axis;

said sofa back having a third long axis and a third cross section perpendicular to said third long axis;

said sofa side having a fourth long axis and a fourth cross section perpendicular to said fourth long axis;

said first cross section, said second cross section, said third cross section, and said fourth cross section each being polygons having a front lower section that is vertical and parallel with the vertical rear section of its respective frame, each front lower section being shorter than the vertical rear section of its respective frame, wherein an angled support surface extends upwardly and rearwardly to an upper horizontal surface on each of said first cross section, said second cross section, said third cross section, and said fourth cross section, the upper horizontally extending surface of each of said first cross section, said second cross section, said third cross section, and said fourth cross section being shorter than and parallel to a lower horizontal surface which extends between the lower edges of the rear vertical surface and the front lower section of each of said first cross section, said second cross section said third cross section, and said fourth cross section;

said third long axis being perpendicular to said fourth long axis; said sofa back having a first end overhang; and said first end overhang resting flush against said angled support surface of said fourth cross section from the height of said front lower section to the height of said vertical rear section.

2. The furniture set of claim 1 further comprising said second long axis being perpendicular to said first long axis; said chaise lounge side having a second end overhang; and said second end overhang resting flush against said angled support surface of said first cross section from the height of said front lower section to the height of said vertical rear section.

3. The furniture set of claim 2 further comprising said chaise lounge base is placed against said sofa base such that said second long axis is coaxial with said third long axis.

* * * * *